United States Patent [19]

Brammer et al.

[11] 4,359,978

[45] Nov. 23, 1982

[54] CONTACTLESSLY CONTROLLED IGNITION SYSTEM FOR INTERNAL COMBUSTION ENGINE

[75] Inventors: Hartmut Brammer, Vaihingen; Heinz Leiber, Leimen, both of Fed. Rep. of Germany

[73] Assignee: Robert Bosch GmbH, Stuttgart, Fed. Rep. of Germany

[21] Appl. No.: 214,717

[22] Filed: Dec. 9, 1980

[30] Foreign Application Priority Data

May 16, 1980 [DE] Fed. Rep. of Germany ..... 3018787

[51] Int. Cl.[3] ..... F02P 7/00; F02P 3/06; F02P 1/00; F02P 7/06

[52] U.S. Cl. ..... 123/146.5 A; 123/617

[58] Field of Search ..... 123/146.5 A, 617, 618, 123/414; 200/19 DC, 19 DR

[56] References Cited

U.S. PATENT DOCUMENTS

| | | | |
|---|---|---|---|
| 3,375,812 | 4/1968 | Koda | 123/617 |
| 3,855,983 | 12/1974 | Valck | 123/146.5 A |
| 3,875,920 | 4/1975 | Williams | 123/146.5 A |
| 3,989,023 | 11/1976 | Florio et al. | 123/617 |
| 4,165,726 | 8/1979 | Helmer, Jr. | 123/617 |
| 4,235,213 | 11/1980 | Jellissen | 123/146.5 A |
| 4,307,698 | 12/1981 | Yoshinari | 123/146.5 A |

FOREIGN PATENT DOCUMENTS

| | | | |
|---|---|---|---|
| 55-0128664 | 10/1980 | Japan | 123/146.5 A |

*Primary Examiner*—Raymond A. Nelli

*Attorney, Agent, or Firm*—Frishauf, Holtz, Goodman & Woodward

[57] ABSTRACT

In an ignition distributor of a contactless controlled coil ignition system the stationary elements (16–21) of a Hall transducer are undetachably integrated in the distributor casing (10,30) or in a carrier plate (40). A plug connector casing (25,35) consisting of insulating material and providing with connector prongs (24) is spaced radially from the distributor casing (10,30) or from the carrier plate (40). The integration of the stationary elements of the Hall transducer and of the plug connector casing makes possible a construction of the ignition distributor that is compact and favorable for manufacturing technology.

4 Claims, 3 Drawing Figures

CONTACTLESSLY CONTROLLED IGNITION SYSTEM FOR INTERNAL COMBUSTION ENGINE

STATE OF THE ART

The invention concerns ignition system for internal combustion engines. The stationary elements of the Hall-transducer having a Hall transducer comprising stationary parts as well as a pulse-inducing wheel fixed as to rotation on the distributor shaft such as have heretofore been housed within the distributor casing of such systems are usually embedded in a so-called magnet enclosure of insulating material which is undetachably fastened on a stationary carrier plate or a swinging interruptor plate in such a way that the disposition provides the predetermined air gap for the pulse transducer wheel.

In practice it has been found that magnet enclosures riveted on in that manner do not always take on trouble-free positioning with respect to the pulse transducer wheel and accordingly supplementary precautions are necessary in order to stabilize the air gap.

THE INVENTION

Briefly, the stationary elements of the Hall transducer are integrated directly into the distributor casing or into a carrier plate without the provision of a supplementary magnet capsule casing.

Ignition systems according to the invention embodying such a distributor have, in contrast, the advantage that supplementary precautions for stabilizing the air gap are not necessary. The invention lends itself to realization, however, only with a coil ignition system in which the load-dependent shifting of the ignition timing is not produced by a membrane-actuatable interruptor plate, but instead a signal proportional to the engine intake vacuum is supplied to the control part of the system.

If the Hall transducer is mounted outside the distributor casing and half of the necessary plug connector for connecting the Hall transducer is located outside the distributor casing, the costs of manufacture ,moreover, are reduced. A proper production disposition of the Hall transducer and its shake-proof connection with the prongs of the plug connector casing are obtained when the magnet and one of its magnetically conducting pieces are directly integrated in the distributor casing and the rest of the stationary parts of the transducer are cast in the distributor casing with connection pieces undetachably connected to a connector plug.

DRAWING

Three embodiments of the invention are represented in the drawing and are more closely explained in the following description.

DESCRIPTION OF THE ILLUSTRATED EMBODIMENTS

Figure 1:
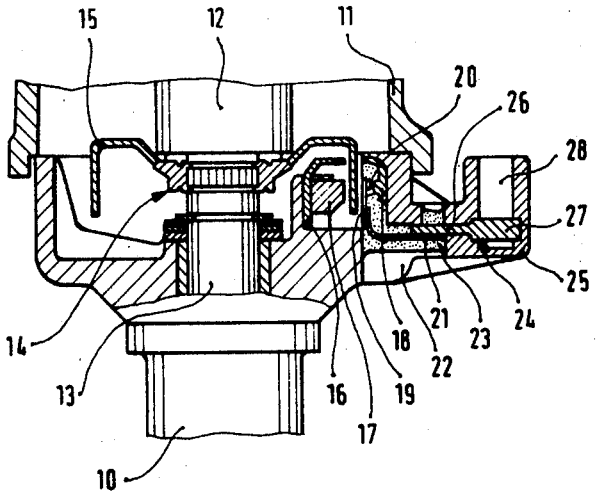
FIG. 1 shows an ignition distributor partly sectioned axially at scale.

FIG. 1 shows an ignition distributor of a contactlessly-controlled coil ignition system having a distributor casing 10, a distributor cap 11 and a distributor rotor 12, which are made of insulating material. On a distributor shaft 13 in bearings in the casing 10 the rotor 12 is pressed down for fixing with respect to rotation and a metal pulse transducer wheel 14 is fastened that has a number of teeth 15 parallel to the shaft 13.

A first conducting piece 16 of a Hall transducer is directly integrated with a permanent magnet 17 thereof in the distributor casing 10, i.e. embedded directly in the latter in manufacture. A second conducting piece 18 and a ceramic carrier 19 with a Hall-IC 20 and three connection pieces 21 (that lie one behind the other) are cast in a cavity 22 of the distributor casing by means of an insulating mass 23. These elements embedded and cast in the casing are designated as the stationary elements of the Hall transducer.

A plug connector casing 25 is spaced essentially radially outwards from the distributor casing 10 and both casings are made of one piece of insulating material. A total of three connector prongs 24—that are shown lying one behind the other—are so disposed in the plug connector casing 25 that the end section 26 of each prong 24 is undetachably connected with a connection piece 21, preferably by welding, with the result that the knife contact 27 of each prong 24 projects into a cavity 28 open to one side in the plug connector casing 25. In the latter is a movable connector unit, not shown, the three connector bushings of which cooperate with the prongs 24 and thereby produce an electric coupling.

Figure 2:
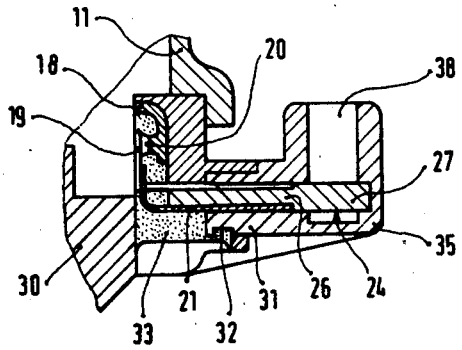
FIG. 2 shows the separate plug connector casing in axial section and full scale.

The distributor casing 30 in FIG. 2 consists of electrically conducting material, and the plug connector casing 35 made of insulating material has a plug 31 with a groove 32. The plug 31 inserted in the distributor casing 30 is cast into place with an insulating mass 33, so that both casings 30,35 are joined together after the fashion of an undetachable locked connection. The stationary elements of the Hall transducer are fastened in the distributor casing 30 similarly to FIG. 1.

Figure 3:
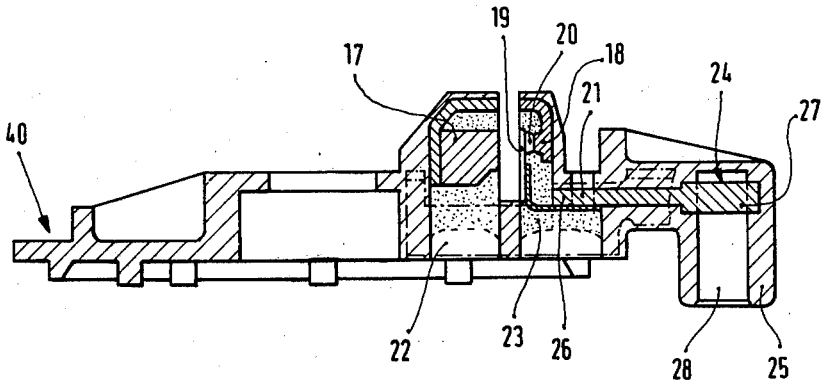
FIG. 3 shows a carrier plate with a built-on plug part in axial section and magnified scale.

The embodiment in FIG. 3 is distinguished from that in FIG. 1 in that the stationary elements of the Hall transducer are integrated, not in the distributor casing, but directly in a carrier plate 40 of insulating material without any further casing. Parts already described in FIG. 1 are provided with the same reference symbols and have the function there described.

We claim:

1. A contactless control structure at least partly built into the distributor of the ignition system of an internal combustion engine, said structure including a Hall transducer having a pulse-inducing wheel and also stationary parts, comprising the improvement which consists in that:

all the stationary elements of the Hall transducer are directly integrated without any supplementary casing into the distributor casing;

a connector (24, 25, 35) for external connections to the Hall transducer is affixed to the distributor casing (10, 30);

the stationary elements of said Hall transducer comprise two magnetically conducting pieces of magnetically soft material, a permanent magnet, a Hall-IC mounted on a ceramic carrier and connection pieces;

said permanent magnet (17) and one of said magnetically conducting pieces (16) are directly integrated in the distributor casing;

the other magnetically conducting piece (18) said ceramic carrier (19) with said Hall-IC and said connection pieces (21) are insulatingly case within the distributor casing, and said connector (25, 35) for external connections has a plurality of connector prongs (24), each of which is undetachably connected to an individual line of said connection pieces (21).

2. A contactless control structure as defined in claim 1 in which the body on which said connector (25) is affixed, as well as said connector (25) are made of insulating material and both are both of one piece.

3. A contactless control structure as defined in claim 1 in which several connector prongs (24) are provided within said connector (25) in a manner suitable for coupling said prongs with the respective connector bushings of a movable complementary connector unit.

4. A contactless control structure as defined in claim 1 in which said connector (25, 35) is spaced radially outwards from said distributor casing (10, 30, 40) and is connected therewith.

* * * * *